United States Patent [19]

Cole

[11] 4,023,544

[45] May 17, 1977

[54] PRECOMBUSTION CONDITIONING DEVICE FOR INTERNAL COMBUSTION ENGINES

[75] Inventor: James D. Cole, Dundee, Ill.

[73] Assignee: F. D. Farnum Co., Lyons, Ill.

[22] Filed: Feb. 14, 1975

[21] Appl. No.: 549,947

[52] U.S. Cl. ..... 123/119 E; 123/141; 48/180 R; 261/DIG. 48; 431/2

[51] Int. Cl.[2] ..... F02M 29/00

[58] Field of Search ..... 123/141, 119 E, 122 F; 48/180 R; 219/206, 207; 261/DIG. 48; 431/2

[56] References Cited

UNITED STATES PATENTS

| | | | |
|---|---|---|---|
| 1,506,601 | 8/1924 | Nelson | 123/141 |
| 1,771,626 | 7/1930 | Hamilton | 123/119 E |
| 1,854,475 | 4/1932 | Littlefield | 123/119 E |
| 1,896,786 | 2/1933 | Oppenheim | 123/119 E |
| 2,899,949 | 8/1959 | Hicks | 123/119 E |
| 3,747,581 | 7/1973 | Kolb | 123/141 |
| 3,749,545 | 7/1973 | Velkoff | 123/119 E |
| 3,885,539 | 5/1975 | Hicks | 123/119 E |

*Primary Examiner*—Ronald H. Lazarus

[57] ABSTRACT

A precombustion conditioning device for gasoline fired internal combustion engines comprising at least one cupped or dished foraminous member disposed across the fuel-air intake passageway of the engine between the carbuetor and fuel-air inlet of the engine, with the foraminous member being electrically insulated from both the carburetor and the engine, with the foraminous member being electrically connected to the positive terminal of a direct current power source, such as the automobile battery, and the negative terminal of the power source being connected to the engine and hence the inside wall of the intake manifold. The mixture of air and gasoline passes through the positively charged foraminous member where the liquid gasoline particles involved, through contact, become positively charged, whereby the positively charged particles repel each other and in passing into the engine intake manifold are attracted to and against the negatively charged interior walls of the manifold and engine to be spread out in thin layers for maximized evaporation of the gasoline, with resultant improved engine performance, gasoline mileage, and reduction of pollutants.

8 Claims, 13 Drawing Figures

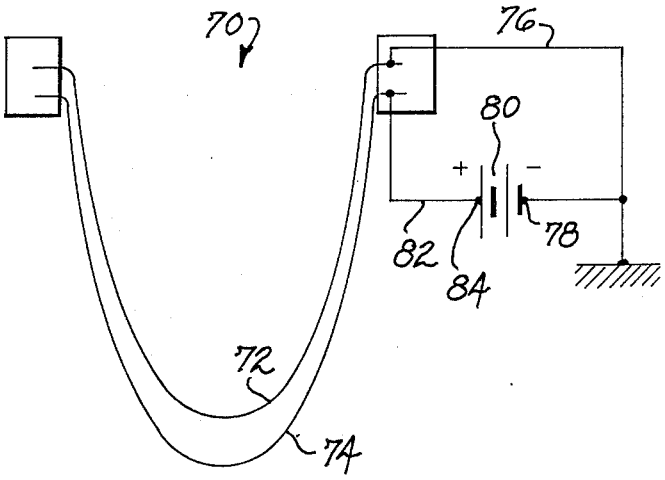
FIG. 9
FIG. 10
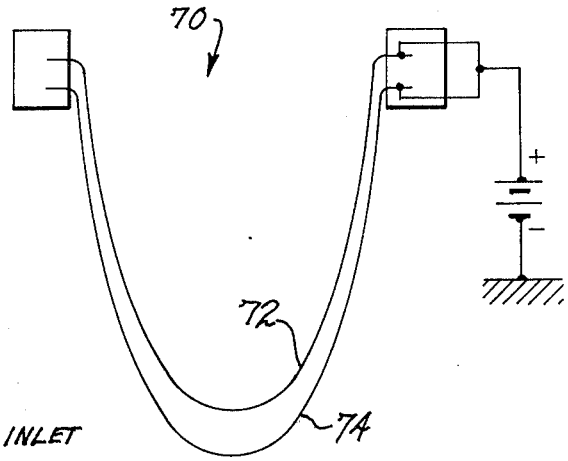
FIG. 11
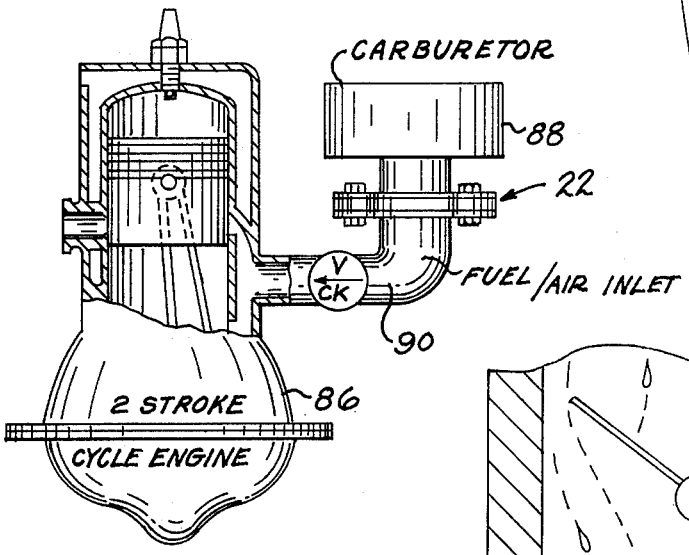
FIG. 12
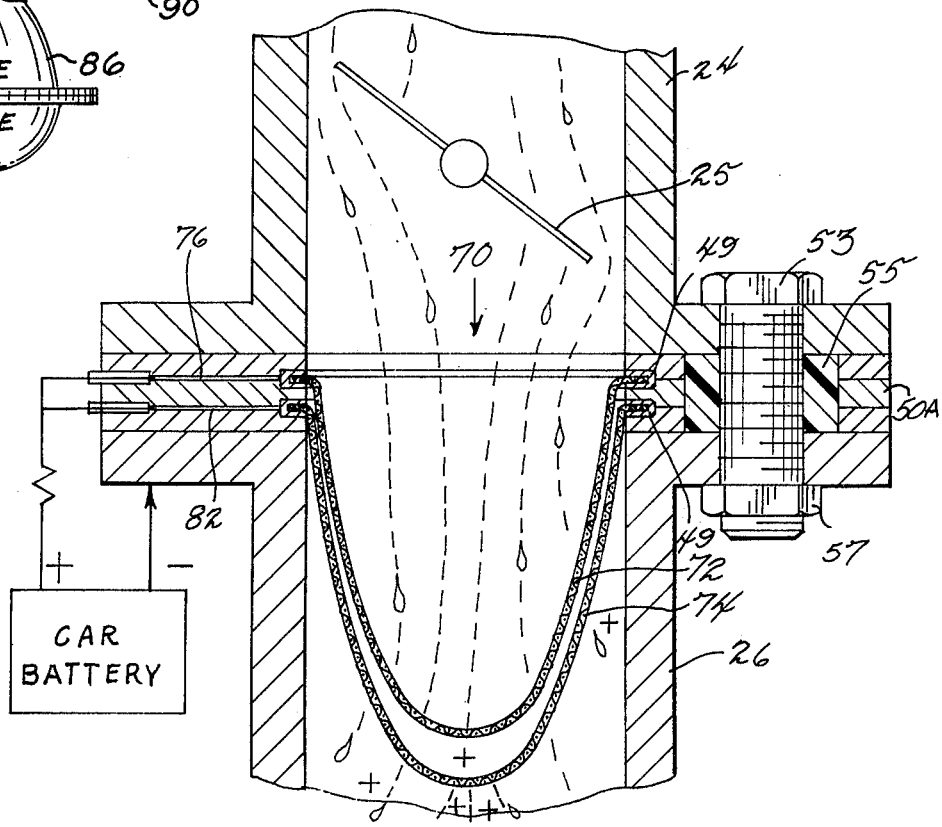

PRECOMBUSTION CONDITIONING DEVICE FOR INTERNAL COMBUSTION ENGINES

This application discloses subject matter common to the application of the applicant and J. Byron Hicks Ser. No. 445,931, filed Feb. 26, 1974 now abandoned, and entitled "Device for Beneficially Modifying the Characteristics of a Mixture of Air and Fine Particles of a Vaporizable Fuel Prior to Directing the Same Over a Metal Surface of a Path to a Combustion Zone"

This invention relates to a precombustion conditioning device and method for internal combustion engines, and more particularly, to a precombustion conditioning device for gasoline fired internal combustion engines for improving combustion and gasoline mileage.

Modern problems of pollution control and fuel shortages have made urgent the need for the finding of more efficient ways of fueling internal combustion engines, and this is particularly true of gasoline engines, especially those designed for automobile use. Gasoline consumption efficiency improvements in the past have, in general, been concerned with the engine itself, such as providing higher compression ratios with consequent increase in theoretical and actual cycle efficiency, better firing, better combustion chamber design, and freer flow of gases. However, modern pollution control approaches to automobile pollution problems currently involve such things as exhaust gas catalysts and pollution control valves which tend to negate the effect of many improvements built into gasoline engines for engine efficiency purposes.

A principal object of the present invention is to provide a precombustion conditioning device and method that conditions that fuel-air mixture for maximum combustion before the fuel-air mixture enters the engine cylinders, utilizing electrostatic principles for effective vaporization of the gasoline in the fuel-air mixture.

Another principal object of the invention is to provide an electrostatic precombustion conditioning device that effects a positive charging of the fuel particles in the fuel-air mixture prior to the entry of the mixture into the engine manifold, and an opposite charging of the manifold itself, for biasing the movement of the fuel particles to effect substantially full vaporization of the fuel.

Yet another object of the invention is to provide a precombustion conditioning device that utilizes the fast acting charging action of electrostatics to provide maximized vaporization of the fuel prior to entry of same into the engine cylinders.

Still another object of the invention is to provide an automobile fuel precombustion conditioning device that is effective for cold starts, heavy engine loads, and high engine speeds.

Yet still another important object of the invention is to provide a precombustion conditioning device especially adapted for gasoline fired engines which reduces the amount of undesirable pollutants in the engine exhaust, increases mileage per gallon of gasoline, and enables less expensive gasoline of lower octane rating to be employed without inducing knocking.

Further objects of the invention are to provide a precombustion conditioning device especially suited for gasoline fired automobile engines that is composed of few and simple parts, that is economical of manufacture, that is convenient to install, and that is long lived and reliable in use.

In accordance with the invention, there is interposed between the carburetor and fuel-air mixture intake of the engine a foraminous member that is dished or cupped in the direction of fluid flow, and through which the fuel-air mixture is directed. The foraminous member is provided with a circumambient flange portion that is mounted in a gasket formed of electrically insulating materials of conductivity on the order of $3 \times 10^{-9}$ MHO/meter which is in turn shaped to be applied in a conventional manner between the clamping flanges at the carburetor outlet and the engine air intake manifold inlet. The foraminous member preferably is in the form of a screen formed from any suitable electrically conductive material, such as steel, copper, stainless steel, or other ferrous or non-ferrous electrically conductive metals, and it is applied to the gasket so as to be electrically insulated and isolated both from the carburetor and the engine.

The foraminous member is electrically connected to the positive terminal of a suitable source of direct current power, such as the automobile battery, and the engine block is electrically connected to the direct current power source negative terminal. The power source should be such that the foraminous member has at least a 2 volt charge relative to the engine block. For this purpose a suitable lead may be employed to connect the car battery positive terminal to the foraminous member and a second suitable lead employed to connect the car battery negative terminal to the engine block. The foraminous member preferably has a mesh size in the range of from about 10 to about 30, with the distance between wires across the mesh openings being approximately 0.025 to 0.090 inch. Wire diameters of 0.007 to 0.012 inch are generally optimum.

In operation, foraminous member positively charges the liquid gasoline particles of the fuel-air mixtures as the latter sweeps by and through the foraminous member, by electrostatic contact charging of the particles. As the mixture of positively charged liquid gas particles and air moves into the intake manifold, the positively charged liquid particles repel each other and are attracted to and impinge against the negatively charged walls of the intake manifold and engine. This spreads the liquid gasoline particles out thinly over the manifold surfaces involved so that the turbulent air flow and partial vacuum conditions involved, together with the engine heat involved, achieve maximized vaporization of the gasoline for more uniform distribution to the engine cylinders and cleaner burning characteristics. The result is a smoother running engine, freedom from carbon deposits, and improved gas mileage.

Other objects, uses and advantages will be obvious or become apparent from a consideration of the following detailed description and the application drawings in which like reference numerals indicate like parts throughout the several views.

In the drawings:

FIG. 9 is a schematic view similar to that of FIG. 5 illustrating the electrical circuiting for the device of FIG. 8;

FIG. 10 is a view similar to that of FIG. 9 but showing a modified electrical circuit arrangement;

FIG. 11 is a view similar to that of FIG. 1 but showing the device of FIGS. 1 – 4 operably associated with a two stroke cycle internal combustion engine, with the engine being partially broken away;

FIG. 12 is a diagrammatic view, similar to that of FIG. 8, but illustrating the fuel-air flow through the device.

Figure 1:
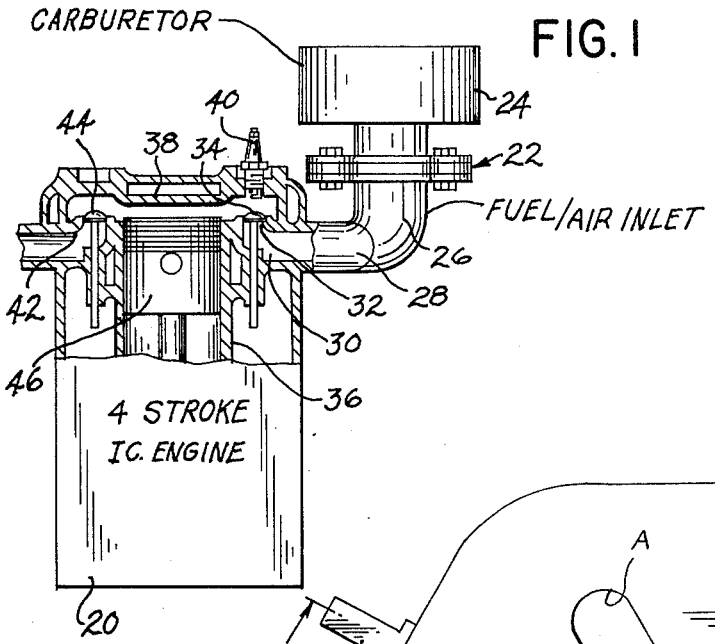
FIG. 1 is a diagrammatic elevational view, partially in section, of familiar parts of a gasoline four stroke internal combustion engine, showing the location of one embodiment of the invention between the engine carburetor and the fuel-air inlet of the engine.

However, it is to be understood that the specific drawing illustrations provided are supplied primarily to comply with the requirements of the Patent Laws, and that the invention is susceptible of other embodiments that will be obvious to those skilled in the art, and that are intended to be covered by the appended claims.

Referring first to the embodiment of FIGS. 1 – 5, reference numeral 20 generally indicates a conventional gasoline fired four stroke cycle internal combustion engine, of the general type employed in connection with automobiles, with which there is associated a combustion conditioning device 22 arranged in accordance with the present invention.

The device 22 is interposed between the carburetor 24 and the fuel-air inlet 26 to the engine 20 and more specifically, the device 22 is interposed between the outlet of the carburetor 24 (provided with the usual throttle butterfly 25) and the inlet to the engine intake manifold 28 that forms the inlet 26. The manifold 28, as customary with engines of the type indicated, has several delivery branches each terminating at a different engine intake port 30 (only one of which is shown for illustrative purposes) for the respective engine cylinders 36. As is conventional the engine intake ports 30 each lead to an intake valve seat 32 with which there is operatively associated an intake valve 34 that intermittently opens and closes the opening defined by the valve seat 32 in the well-known manner as part of the operation of four stroke cycle internal combustion engines. Each intake valve 34 is, of course, operatively associated with a different cylinder 36 having a cylinder head 38 in which a spark plug 40 is operatively mounted. Each cylinder is operatively associated with an outlet valve seat 42 that is periodically opened and closed by an outlet valve 44 that leads to a port (not shown) opening into an exhaust manifold (not shown) which conventionally is connected to the usual exhaust pipe. Each cylinder has a piston 46 reciprocable therein or operatively connected to the usual engine crank shaft for driving same. The construction of the various engine parts may be in accordance with any conventional arrangement and the motor specifically shown has been illustrated for the purpose of showing a typical application of the invention and indicating those parts of a typical four stroke cycle internal combustion engine with which the device 22 cooperates in accordance with the invention.

It is assumed that the carburetor 24 includes the usual throttle butterfly valve member 25 (diagrammatically illustrated in FIGS. 12 and 13), and means for regulating the supply of fuel to the mixing chamber of the carburetor. The fuel the Applicant is primarily concerned with is gasoline, which typically is a blend principally composed of various vaporizable volitizable liquid hydrocarbons as, for example, iso-octane, a hydrocarbon of high antiknocking value (100 on the octane scale), and normal heptane, a hydrocarbon of low antiknocking value (which is zero on the octane scale).

As is well known, the gasoline fuel employed is sprayed in the form of small particles into the airstream moving through the carburetor where the fuel and air mixes to form the mixture that is to fire the engine 20.

In accordance with the present invention, the fuel, after being introduced into the airflow and mixing with the air, on passage of the resulting mixture out of the carburetor, the mixture passes through the precombustion conditioning device 22 in moving into the engine intake manifold 28.

Figure 4:
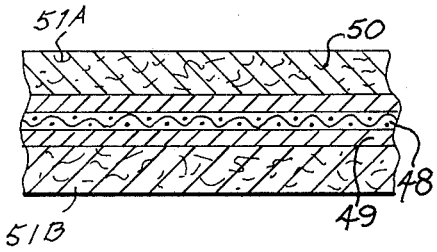
FIG. 4 is a fragmental cross-sectional view taken substantially along line 4—4 of FIG. 3.
Figure 2:
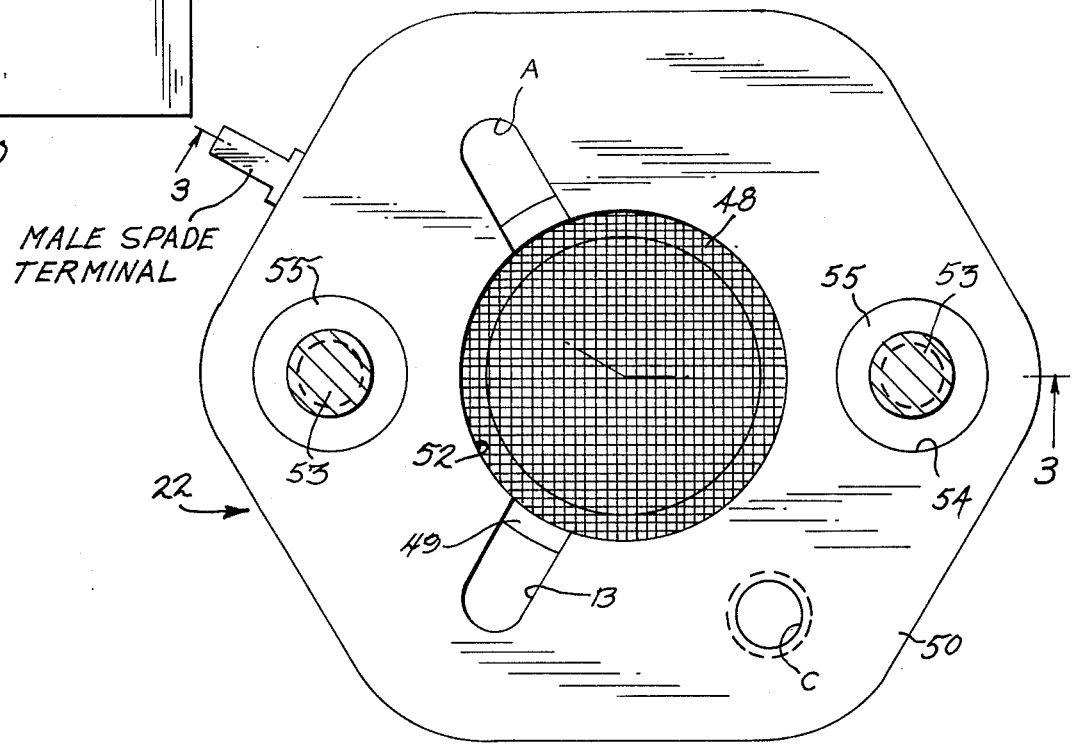
FIG. 2 is a top plan view of the device of FIG. 1, shown on an enlarged scale, and as mounted in operating position, with its securing bolts shown in section.
Figure 3:
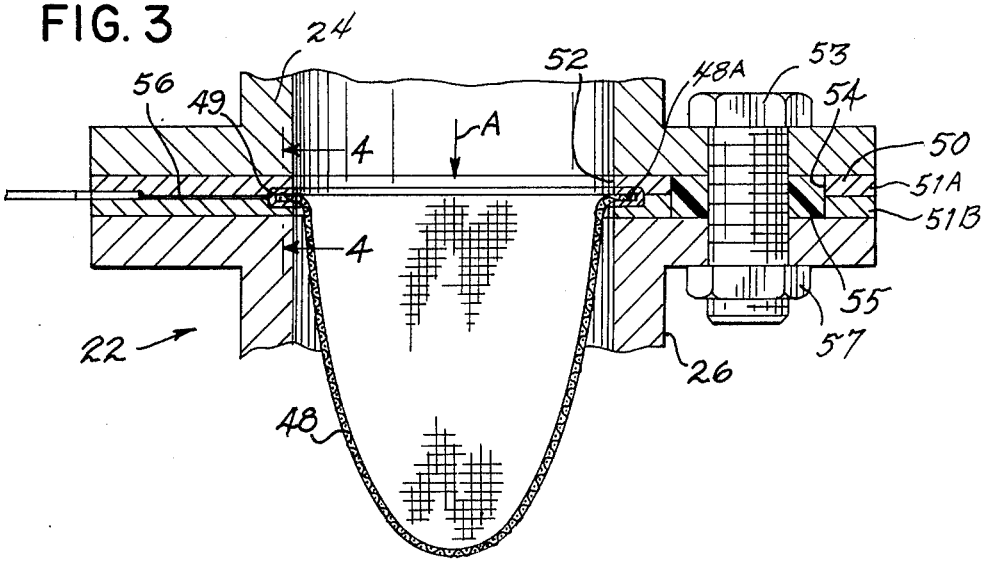
FIG. 3 is a cross-sectional view of the device shown in FIG. 2, taken substantially along line 3—3 of FIG. 2, and showing the gasketing in block diagram form.

Referring more specifically to FIGS. 2 – 4, the device 22 comprises a foraminous member in the form of a screen 48 formed from electrically conductive material; the screen 48 is preferably formed from an electrically conductive metal such as steel, copper, stainless steel, or a suitable ferrous or non-ferrous metallic substance that is electrically conductive. The material employed may be suitably plated to resist corrosion.

Screen 48 is in practice in the form of a wire cloth having a mesh size in the range from about 10 to about 30 mesh. By way of example, the screen 48 may be formed from 30 mesh wire cloth having about 1,000 openings per square inch with the wires having a thickness of 0.007 to 0.012 inch so that the distance between wires across the mesh opening measures about 0.025 to 0.090 inch.

As indicated, in FIG. 3, the screen 48 is dished or cupped in the direction of fluid flow and defines a circumambient flange portion 48A which is reinforced by a grommet 49 in circumambient relation to the flange portion 48A. Grommet 49, formed from a suitable electrically conductive metallic material, such as one of the materials specified for the screen 48, is of U-shaped transverse cross-sectional configuration having the base of the U facing outwardly and the legs of the U crimped against the screen flange portion.

As indicated, the wire cloth forming the screen 48 need not be made of any special metal or present a surface of any special metal, though the material employed should be electrically conductive. Similar remarks apply to the material from which the grommet 49 is formed. It is desirable that the screen 48 be plated with metals that resist rusting or corrosion, as already indicated.

The screen 48 is supported by being mounted in gasket 50 that is formed from suitable electrically insulative gasket materials, of a conductivity on the order of $3 \times 10^{-9}$ MHO/meter, as one function of the gasket is to electrically insulate the screen 48 and its grommet 49 from the carburetor and engine intake manifold.

A suitable gasket 50 may comprise several layers of 51A and 51B formed from a suitable phenol formaldehyde resin reinforced with asbestos fibers, with the two layers being suitably apertured and recessed to define the gasket's central opening 52 and receive the grommet 49, with these parts being suitably bonded together so that the gasket 50 and the grommet 49 together with the screen flange portion 48 are in coplanar relation with the grommet 49 and screen flange portion 48A embedded in the gasket in the manner indicated in FIG. 3.

The gasket layers alternately may be formed from a mixture of wood fibers, nitrile rubber, asbestos, and resins (such as the R-90 resins made and sold by F. D. Farnam Company).

As indicated in FIG. 2, the gasket 50 is also formed with the usual bolt receiving openings 54 through which pass the bolts 53 that receive the usual nuts 57 for clamping the carburetor and intake manifold flange portions against the gasket in the manner indicated in FIG. 3, to mount the gasket 50 and its associated screen 48 in its operative position. The gasket openings 54 may be provided with bolt bushings 55 of the type described in Farnam U.S. Pat. No. 3,811,689, to provide for obtaining a predetermined compression of the gasket 50. m Gasket 50 may also be formed with one or more of the usual openings, indicated at A, B, and C in FIG. 2, for specific fluid flow purposes of a conventional type. Openings A and B are partial depth openings while opening C is through the gasket 50.

Figure 5:
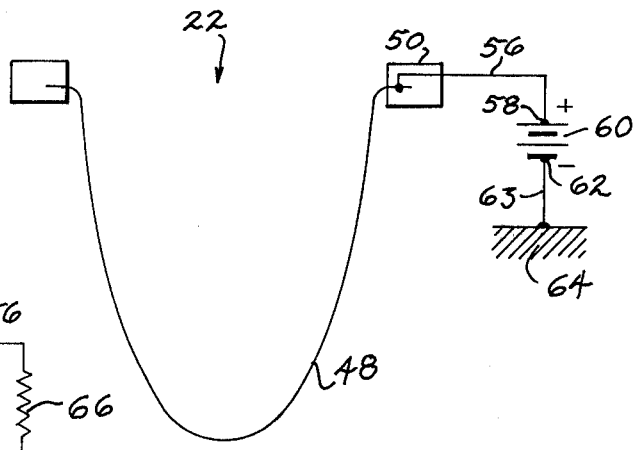
FIG. 5 is a schemmatic view of the device of FIGS. 1 – 4 connected in accordance with the invention to the positive terminal of a direct current power source, of which the negative terminal is connected to the engine ground.

A basic aspect of this invention is that the screen 48 be connected to the positive terminal of a source of direct current electrical power and that the negative terminal of the direct current source of power be connected to engine ground (that is, grounded to the engine). FIG. 5 diagrammatically illustrates such an arrangement wherein the lead wire 56 is shown to exend from electrical contact with the screen 48 to the positive terminal 58 of a battery 60, the negative terminal 62 of which is connected by a lead wire 63 to the engine block that is shown as engine ground 64.

The gasket 50, of course, in being fabricated has a portion of lead 56 built into same (which portion preferably is of the flat type), as indicated in FIG. 3, so that when the gasket 50 and its associated screen 48 are bonded together, the end of the lead 56 in electrical engagement with the screen 48 is embedded within the gasket 50. Lead 56 may be affixed to either the screen 48 or the grommet 49, or both, by soldering, brazing, or suitable mechanical joining means.

Although any suitable source of direct current power may be employed for purposes of this invention, as for instance, a dry cell battery, it is more convenient to employ the automobile battery that is employed to start the car and run auxiliary equipment (such as the radio).

It has been found that any drain on the car battery, due to use of same for charging the device 22 as indicated, is essentially negligible in absence of a short circuit from the screen to the motor block due to failure of the gasket. The standard available voltages with conventional automobile batteries are either 6 or 12 volts and both have been found to operate satisfactorily in practicing the invention. It has been found that to satisfy requirements it is sufficient that the gasket 50 have sufficient dielectric or electrically insulating characteristics to avoid objectionable electrical current drain. The combined leakage current and charging current is in the 1 to 10 microampere range. The screen 48 should have a minimum 2 volt charge as compared to the manifold.

Higher voltage direct current power sources, such as the 24 volt battery used in aircraft, with which the invention is also utilizeable, also will function satisfactorily. Other suitable direct current sources are an inductive rectified therefor coupling to an ignition coil primary, and a rectified output from an alternator. Furthermore, while a unidirectional electrical power source is essential to the practice of the invention, so that screen 48 is always positively charged, the power source may be of the pulsating type.

As indicated, the screen 48 is preferably dished in the direction of fluid flow, so as to present a concave configuration facing upstream and a convex configuration facing downstream. The dished or cupped shape employed may be substantially conical or more closely approaching an elongated hemispherical configuration, the latter being shown in the drawings. This disposes the majority of the openings of the screen 48 at a substantial angle with respect to the direction of fluid flow, whereby the fuel-air mixture has to make a tortuous or convoluted flow through much of the screen in order to pass therethrough, thereby insuring that most of the fuel particles in the fuel-air mixture will make at least some engagement with the screen to become positively charged.

Tests have shown that an automobile engine equipped with the precombustion conditioning device 22 electrically connected as indicated, to charge the screen positively and the engine ground negatively, will operate to increase gasoline mileage, reduce the presence of undesirable pollutants in the exhaust, and lower the octane reading of the gasoline required to prevent knocking. The device 22 is obviously inexpensive of manufacture, has sufficient structural integrity to resist damage due to mishandling, and has been found to be reliable in operation, experiencing no undesirable lessening of efficiency over protracted periods of time for extensive mileage, and under conditions of heavy loads at high speeds.

During operation of the vehicle, the passage of the fuel particles through the screen 48 imparts a positive electrostatic charge of the contact transmitted type, to the particles, which positive charge causes the particles involved to repel each other and be electrostatically attracted to the negatively charged metal walls of the manifold where they impinge andd flatten out against the manifold surfaces involved for maximum exposure of the liquid to air, resulting in thorough vaporization of the fuel in the fuel-air mixture. This action also occurs in the engine block passages upstream of the respective cylinders 36 to the extent that any liquid fuel particles pass through the manifold.

This electrostatic action on the fuel particles in both spreading out the individual fuel particles relative to each other and individually into a thin layer over against the intake manifold and engine surfaces involved, makes it possible for the turbulent air flow conditions and partial vacuum conditions, as well as the temperature of the engine surfaces involved, to effect substantially full evaporation of the fuel in the air-fuel mixture.

This fuel particle charging by contact has the advantage of maximum charging speed and minimum voltage requirements, as distinguished from field effect charging systems (involving passing the particles between spaced electrodes). Thus, a screen charge of two volts is ordinarily adequate for the present invention while thousands of volts are required for field effect systems.

As unvaporized fuel does not combust as readily as vaporized fuel, the increase achieved by the invention in the amount of fuel vaporized prior to reaching the engine cylinders insures improved combustion efficiency.

Furthermore, unvaporized gasoline particles in moving from the carburetor into the engine cylinders, have a tendency to flow from the carburetor into the cylinders that are closest to the carburetor, This tends to provide such cylinders with a mixture of air and gasoline that has more gasoline in it than the cylinders which are further away; in fact, the cylinders farthest from the carburetor tend to be fuel starved. By improving the vaporization of the gasoline fuel in accordance with the invention, the fuel is distributed to each cylinder more uniformly to again improve efficiency as well as to achieve more cleaner running. The result is that the engine runs smoother and on less gasoline when the invention is employed.

Moreover, the charged gasoline particles flow that is attracted to the interior walls of the engine has been found to have an effect on the engine walls over a period of time that results in removal of carbon and resin deposits from the engine walls involved (the intake manifold and engine block passages leading to the cylinders), with the result that the carbon and resin deposits, where present when the invention is applied to the car, will gradually disappear. The invention increases in effectiveness as such deposits are removed or disappear.

In connection with the removal of such deposits, the invention has been found to work most effectively when the deposits disappear, and yet experience has shown that the use of engine cleaners and solvent cleaners do not make any significant difference in the initial operation of the invention where such deposits are known to exist in the car to which the invention is applied. This may be because the chemicals involved interfere with the electrical functioning of the charged fuel-air mixture flow.

In any event, it is believed that, in addition to the fuel vaporization aspects of the invention, the removal of engine deposits may come by way of a scrubbing action on same that is effected by the bombardment that occurs due to the impingement of the charged liquid fuel particles against the negatively charged engine wall surfaces.

Alternately, the deposit removal may be the result of oxygen combining with the carbon of the deposits along the interface between the fuel-air fluid flow and the metal surfaces involved which results in the carbon being carried away in the form of carbon monoxide and carbon dioxide. Thus, it may be that the two volt positive charge for the screen contemplated by the present invention is sufficient to cause the oxygen in the fuel-air flow involved to approach the carbon with enough energy to combine with same to form carbon dioxide and carbon monoxide during the clean up period. Tests have shown otherwise unexplainable increases in CO and $CO_2$ during the clean up period (on engines that are carboned up). At the end of the clean up period the CO content of the exhaust is reduced by about one order of magnitude.

Tests have shown that, assuming the device has been applied to a used automobile, the automobile engine will exhibit an improvement in performance and a 3 to 5 percent increase in gasoline mileage during the first 1,500 miles of use (with the invention applied and operative as disclosed herein). Thereafter, a slower and more gradual increase in gasoline mileage occurs, with the long term effect being influenced to some extent by the age and condition of the car and the user's driving habits. Tests have shown that the ultimate increase in mileage improvement can be between 10 and 25 percent, as compared to mileage without the device, over the next 5,000 to 30,000 miles after the above indicated first 1,500 mile usage.

In summary, the present invention contemplates that there be present downstream of the motor carburetor, and upstream of the combustion zone, preferably between the carburetor and the engine fuel-air intake, a foraminous member which is electrically insulated from the carburetor andd engine block and has its mesh proportioned in size and oriented to effect maximum contact charging of the liquid fuel particles while accommodating ready passage of same therethrough, with such member being electrically connected to the positive terminal of a direct current power source (such as the automobile car battery), and the engine metal surfaces upstream of the combustion chambers, with which the fuel-air mixture has contact, being negatively charged with respect to the foraminous member. The negatively charged engine surfaces may constitute, for instance, the intake valve seats, and the engine intake valves, and also the walls defining the combustion chamber. These surfaces are ordinarily negatively charged from the same direct current source of energy that is employed to provide the positive charge on the foraminous member.

As indicated, the foraminous member is preferably associated with an electrically insulating gasket, and the direct current circuiting involved has a voltage in the range of from about 2 to about 12 volts, although, of course, higher voltages may be employed, as already indicated, but are not necessary for the practice of the invention.

Figure 6:
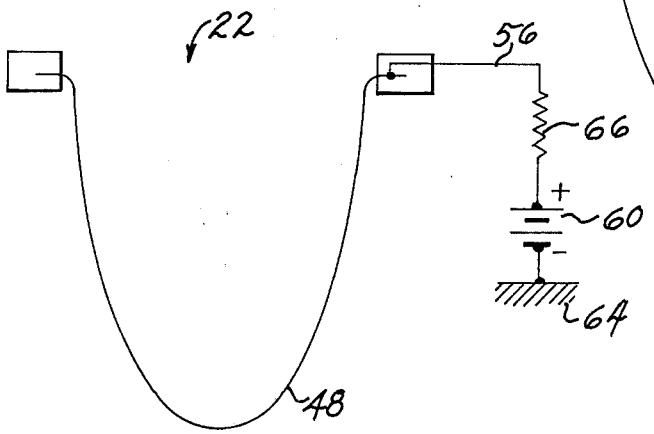
FIG. 6 is a view similar to that of FIG. 5 abut illustrating a modification of the invention employing a voltage limiting resistor series connected in the electrical circuit.

FIG. 6 illustrates a modified embodiment of the invention in which the electrical circuit employed in conjunction with the device 22 includes means to protect the battery 60 from a drain that might be caused by a short circuit or leak to the engine ground. This involves the insertion of a suitable resistor 66 in the lead wire 56. The resistor preferably has a resistance on the order of 10,000 to 500,000 ohms, so as to be of sufficient resistance to prevent the flow of any appreciable current through the electrical circuit in the event that the screen 48 is accidentally grounded. Of course, the resistor can be the lead wire 56 itself, which may be of the known high resistance type, to provide the resistance indicated.

Figure 7:
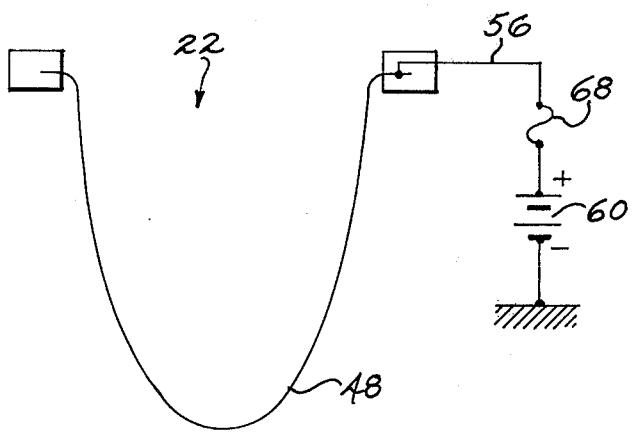
FIG. 7 is a view similar to that of FIG. 5 but showing a fuse series connected in the electrical circuit.

Another arrangement for obtaining the same result is shown in FIG. 7, where fuse 68 is inserted in the lead wire, which will open the circuit in the event of accidental grounding of the screen 48.

Figure 8:
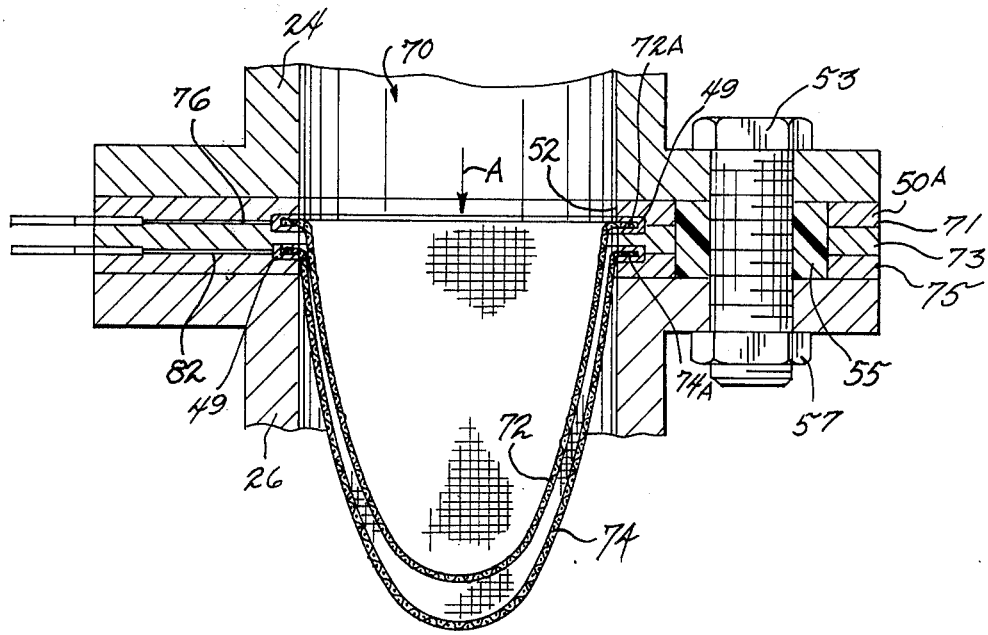
FIG. 8 is a view similar to that of FIG. 3 but illustrating a modified form of the device.

It is also within the scope of the present invention to use two or more sequentially disposed electrically charged foraminous members in the flow path of the fuel-air mixture. This is illustrated in FIG. 8 wherein the device 70 comprises screens 72 and 74, both dished or cupped identically, with the screens 72 being upstream of the screen 74 and spaced therefrom a short distance, such as one eighth of an inch, longitudinally of the direction of flow of the fluids through the device 70.

The screens 72 and 74 are identical to the screen 48 and thus each has its respective flange portions 72A and 74A embraced within a grommet 49, which grommet 49 is the same as described in connection with the showing of FIG. 3.

The gasket 50A comprises the layers 71, 73 and 75 of gasketing material of the type previously referred to suitably bonded together and shaped to receive about the screens 72 and 74 across the gasket through its passage opening 52.

The screens 72 and 74 are then charged in one of several manners. For instance, in the showing of FIG. 9, the upstream screen 72 is connected by lead wire 76 to the negative terminal of direct current battery 80 (which may be the automobile storage battery), while the downstream screen 74 is connected by a lead wire 82 to the positive terminal 84 of the battery 80. The negative terminal of the battery 80 is also connected to engine ground, as by being connected to the engine block.

The results obtained by the arrangement of FIG. 9 are similar to those obtained with the device 22, though it is thought that a lense or refracting effect, that adds increasing motivation of the liquid fuel particles toward the manifold walls, may be caused by the positioning of the negatively charged screen 72 upstream of the positively charged screen 74. Thus, with the two screens being at their respective potentials, the result is that the liquid fuel particles, on being contact charged by the first negative screen 72 are attracted, electrostatically, transverse to the direction of fluid flow, to and through the positive screen 74, for impinging engagement with the manifold walls. The amount of this "refraction" effect will be a function of the relative magnitude of the inertial forces carrying the particle forward and the transverse electrostatic forces acting to move the particles transversely to the inertial forces. The magnitude of the effect will vary with design parameters.

In the arrangement of FIG. 10, both screens 72 and 74 are connected in parallel to the positive terminal of the storage battery, while the negative terminal of the battery is connected to engine ground, as by being connected to the engine block. The effects obtained with the device 70 if so connected will be similar to those obtained with the device 22.

Figure 13:
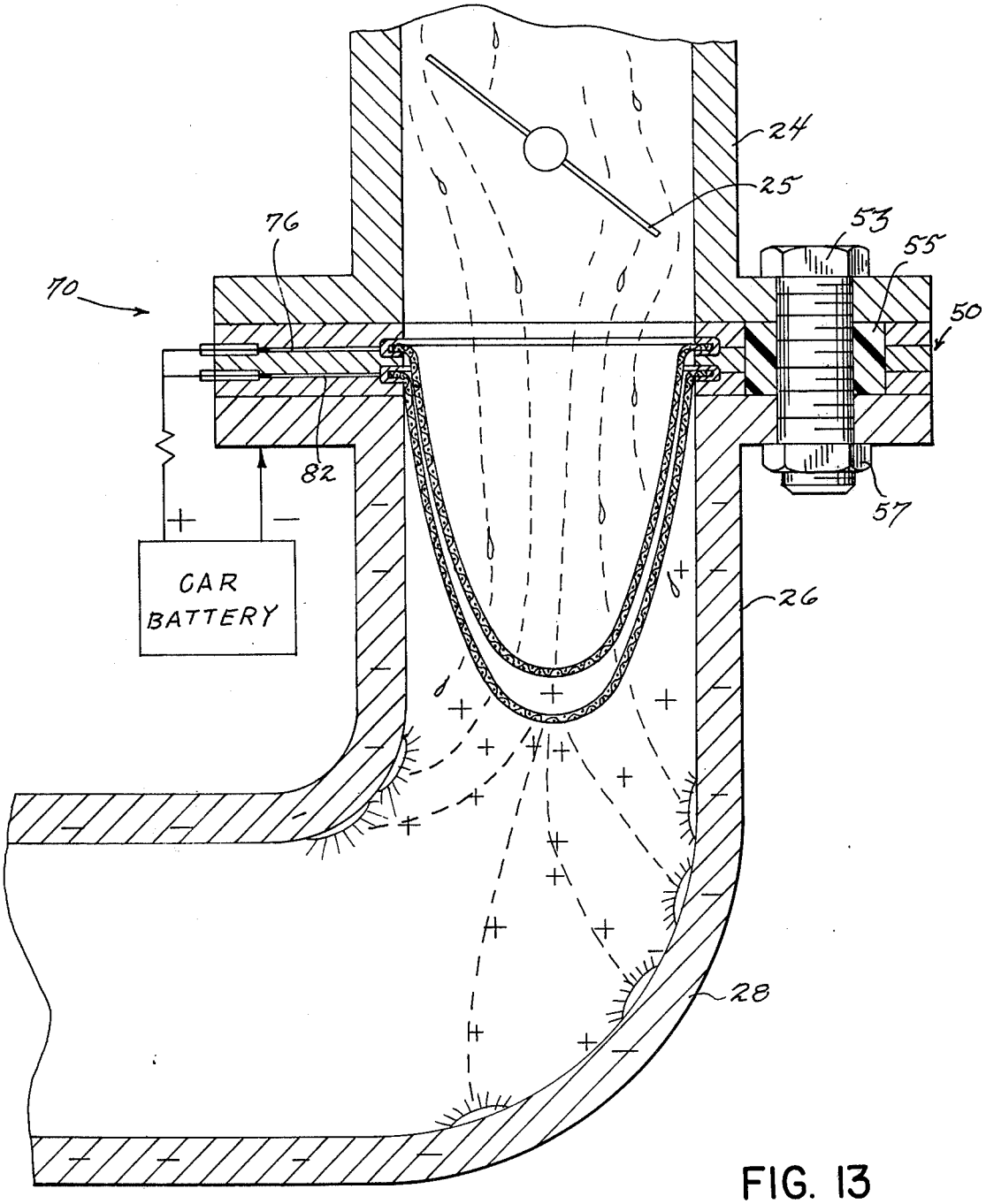
FIG. 13 is similar to FIG. 12 but has an extended showing of the manifold and provides an indication of the manner in which the fuel flow is effected by the practice of the invention.

FIG. 13 illustrates diagrammatically the manner in which the charged fuel particles separate and impinge or impact against the negatively charged manifold surfaces to physically flatten out in a dispersed manner for rapid evaporation, due to fuller exposure to the air flow involved and heating by the manifold as the latter heats up in service, thereby effecting more complete vaporization of the fuel. The charged screens may also have an activating effect on oxygen, resulting in the removal of carbon deposits, as mentioned hereinbefore.

The flattening of the liquid fuel particles against the charged manifold walls is aided by the fact that as the positively charged particles near the negatively charged surfaces involved, the electrostatic attraction action between them increases exponentially (a square law function is involved) which also has a spreading out effect on the individual particles involved. Thus, both the electrostatic effect and the physical impact effect involved are active in thinning down the fuel particles to a desired high surface to volume ratio for maximum faster evaporation effect. The fuel particle impinging action provided by device 22 is similar to that depicted by FIG. 13.

In the two screen forms (FIGS. 9 and 10), the lead wires 76 and 82 have their ends that are disposed at the device 70 suitably electrically connected to the respective grommets 49 and/or the respective screens 72 and 74, whereby the said ends of the leads 76 and 82 are partially embedded within the gasket 50A, as indicated in FIG. 8.

Screens 72 and 74 may be electrically connected to a suitable source of energy to have different positive voltage charges from the same source of DC power with the voltage of the screen 74 being greater than that of the screen 72, whereby a stepped up accelerating effect on the liquid fuel particles will be obtained. Also, the screens 72 and 74 may be made of the same or different materials, as may grommets 49, so long as both are electrically conductive. Preferably the screens 72 and 74 and their grommets 49 are electrically isolated from each other except in the embodiment of FIG. 10 where they are both connected to the battery positive terminal and thus may be electrically connected.

The devices 22 and 70 may also be utilized in connection with two stroke cycle engines, such as, for instance, the marine outboard engine 86 diagrammatically illustrated in FIG. 11. As is well-known, in a two stroke cycle engine, oil is added to the gasoline, the oil being a lubricating oil which after traveling into the engine with the gasoline, lubricates the engine valves and pistons. The oil, due to its high molecular weight, does not vaporize readily, and does not burn well, if at all, in the engine combustion chambers. The oil involved which does not adhere to surfaces to be lubricated is largely exhausted through the outlet manifold and thus forms a source of pollution.

However, by employing a device 22 or 70 in connection with the engine 86, it has been found that the oil involved largely tends to deposit on the surfaces desired to be lubricated on the way into the engine combustion zone. The end result is that the amount of oil exhausted from the engine is very substantially reduced, as compared to engines 86 not so equipped, this being in addition to the efficiency of operation and benefits in gasoline consumption secured from the use of the devices 22 and 70 in connection with the motor 86.

As indicated in FIG. 11, the device 22 there illustrated is interposed between the outlet for the carburetor 88 and the inlet for the motor intake manifold 90. The fine particles of lubricating oil in the fuel-air mixture, due to the operation of the device (assuming it is operatively connected, for instance as shown in one of FIGS. 5 – 7), coat the engine surfaces downstream of the device 22. The oil particles are thus charged by the device 22 to a positive potential so as to be attracted to the negatively charged engine surfaces. Since the oil particles are somewhat heavier than the fuel particles, they will be attracted to the motor surfaces further downstream from the device 22 than those to which the fuel particles are attracted.

It will therefore be seen that the invention provides a simplified type of precombustion conditioning device best used in operative association with gasoline fired internal combustion engines by being interposed between the carburetor and the engine fuel intake passages, as, for instance, in one of the manners shown in the drawings. The device is of few and simple nonmoving parts and sturdily constructed. The electrical connections required are few and simple and the charging of the device is such that inconsequential draining of the battery will be experienced even if the circuit involved is not disconnected when the automobile is not used for extended periods. Under ordinary automobile use, normal recharging of the battery when the motor is running adequately compensates for any drain on the battery during the period the automobile is not used.

Nevertheless, it is within the scope of the invention for the electrical circuiting to include suitable switch means to disconnect the device screen or screens from the source of DC power when the engine motor is turned off. This may involve, if so desired, automatic circuit closing and unclosing arrangements of, for instance, a relay type, which operate appropriately as the ignition is turned on and off to correspondingly connect the device screen or screens to the source of DC power and disconnect same when the motor is to be stopped.

Where the motor is started cold, the spreading out or flattening effect on the liquid fuel particles due to the hereindescribed electric contact positive charging of same and negative charging of the manifold, results in sufficient evaporation, due to the increased ratio of fuel surface area to volume, to effect efficient start ups without the presence of engine heat. The effect of heating on the action involved will follow the arrhenius relationship of doubling the evaporation rate for every temperature increase of 18° F. or 10° C.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In an internal combustion engine fired by a vaporizable liquid hydrocarbon fuel and air mixture and including, in combination, piston and cylinder assemblies within the engine, a carburetor to which the fuel and air are to be supplied to provide the fuel air mixture, said carburetor having an outlet, an engine intake manifold connected between the carburetor and the engine and defining a passageway for forming a fluid flow path for conducting the fuel-air mixture to the engine piston and cylinder assemblies from the carburetor to said assemblies, said manifold hving an inlet connected to the outlet of the carburetor, whereby the fuel-air mixture passes into the manifold, and means for igniting the fuel-air mixture when supplied to said assemblies to drive the engine, the improvement wherein:

the passageway is defined by electrically conductive surfaces, and including means for electric contact charging the liquid fuel particles of the fuel air mixture in passing through the passageway and comprising:

a gasket of electrically insulating material secured about said passageway in circumambient relation thereto.

a screen formed from electrically conductive material supported by, and electrically insulated from the carburetor and manifold by said gasket, and extending across said passageway in screening relation to the full bore defined by same coextensively of and across the width of said fluid flow path within the manifold, said screen having a mesh size lying in the range of from about 10 to about 30, said igniting means including battery means externally of said engine having a positive terminal and a negative terminal, with the positive terminal of the battery means being electrically connected to said screen and the negative terminal of said battery means being electrically connected to said electrically conductive surfaces, said battery means including means for providing a direct current positive charge through said electrical connections to said screen, coextensively of said screen, relative to said surfaces lying in the range of from about 2 to about 25 volts, whereby when said engine is operated and the fuel-air mixture moves from the carburetor through said passageway, the liquid fuel particles of said mixture are contact charged positively by engagement with said screen across the full width of said path for electrostatic attraction to and impingement against said surfaces for effecting electrostatically and by impact effect a high surface to volume ratio for such particles for maximumized evaporation effect, and whereby cleaning of said surfaces of engine deposits thereon is effected.

2. The combination set forth in claim 1 wherein said battery means is a storage battery for the engine.

3. The combination set forth in claim 1 wherein:

said electric contact charging means includes:

a second screen formed from electrically conductive material and supported by said gasket and having a mesh size lying in said mesh range of the first mentioned screen, said second screen extending across said passageway coextensively of the width of said fluid flow path within the manifold and being disposed upstream of said flow path from said first mentioned screen, said second screen being electrically connected to said positive terminal of said battery means.

4. The combination set forth in claim 1 wherein:

said electric contact charging means includes:

a second screen formed from electrically conductive material and supported by said gasket and having a mesh size lying in said mesh range of the first mentioned screen, said second screen extending across said passageway coextensively of the width of said fluid flow path within the manifold and bieng disposed upstream of said flow path from said first mentioned screen, said second screen being electrically insulated from said first mentioned screen, and being electrically connected to said negative terminal of said battery means.

5. The combination set forth in claim 1 wherein said engine is a four-stroke cycle internal combustion engine.

6. The combination set forth in claim 1 wherein said engine is a two-stroke cycle engine.

7. In an internal combustion engine fired by a vaporizable liquid hydrocarbon fuel and air mixture andd including, in combination, piston and cylinder assemblies within the engine, a carburetor to which the fuel and air are to be supplied to provide the fuel-air mixture, an engine intake manifold connected between the carburetor and the engine and defining a passageway for forming a fluid flow path for conducting the fuel-air mixture to the engine piston and cylinder assemblies from the carburetor to said assemblies, and means for igniting the fuel-air mixture when supplied to said assemblies to drive the engine, with the passageway having a fuel atomizing screen disposed thereacross coextensively of the width of the fluid flow path, the method of preconditioning the fuel-air mixture as the mixture passes through the passageway, which method comprises:

electrically charging the screen and the manifold so as to positively charge the screen negatively charge the manifold at a potential in the range of from about 2 to about 25 volts, passing the fuel-air mixture from the carburetor into said passageway and through the screen while positively contact charging the liquid fuel particles as they pass through the screen, and electrostatically impacting the charged liquid fuel particles, on leaving the screen, against the internal surfaces of the manifold and thereby reshaping said particles into a high surface to volume ratio shape in the presence of the fuel-air mixture flow through the manifold for maximized vaporation of such particles.

8. The method set forth in claim 7 wherein the internal surfaces of the manifold bear carbon base deposits, and including utilizing said charging, passing, and impacting steps to effect cleaning of said surfaces.

* * * * *

UNITED STATES PATENT OFFICE

CERTIFICATE OF CORRECTION

Patent No. 4,023,544 Dated May 17, 1977

Inventor(s) James D. Cole

It is certified that error appears in the above-identified patent and that said Letters Patent are hereby corrected as shown below:

Change the name of the Assignee from

"F. D. Farnum Co." to --F. D. Farnam Co.--

Claim 4, line 52, change "bieng" to --being--.

Claim 7, line 64, change "andd" to --and--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*